US006331147B1

(12) United States Patent
Munro et al.

(10) Patent No.: US 6,331,147 B1
(45) Date of Patent: Dec. 18, 2001

(54) SANDBOX WITH ATTACHABLE COVER

(76) Inventors: Liliana Munro, 356 84th Avenue S.E., Calgary, Alberta (CA), T2H 1N4; Olaf Linnartz, 78 Somerglin Rd, Calgary, Alberta (CA)

( * ) Notice: Subject to any disclaimer, the term of this patent is extended or adjusted under 35 U.S.C. 154(b) by 0 days.

(21) Appl. No.: 09/552,596

(22) Filed: Apr. 19, 2000

(51) Int. Cl.[7] ..... A63G 31/00
(52) U.S. Cl. ..... 472/126; 446/478
(58) Field of Search ..... 472/126, 136, 472/137; D21/814, 815; 446/70, 478; 52/66, 72, 79.5

(56) References Cited

U.S. PATENT DOCUMENTS

| | | | | |
|---|---|---|---|---|
| D. 308,088 | | 5/1990 | Mariol . | |
| D. 313,058 | | 12/1990 | Wehmeyer . | |
| D. 334,789 | | 4/1993 | Fish, Jr. . | |
| D. 372,290 | | 7/1996 | Bookstaver et al. . | |
| 1,748,932 | * | 2/1930 | Medart et al. | 472/126 |
| 2,473,047 | * | 6/1949 | Bershad | 472/126 X |
| 3,020,045 | * | 2/1962 | Moss | 472/126 |
| 3,823,426 | * | 7/1974 | Mitchko | 472/126 |
| 3,981,529 | * | 9/1976 | Bontrager | 52/66 |
| 4,343,464 | | 8/1982 | Dose . | |
| 4,515,360 | | 5/1985 | Mariol . | |

* cited by examiner

*Primary Examiner*—Kien T. Nguyen
(74) *Attorney, Agent, or Firm*—I. Zborovsky

(57) ABSTRACT

A sandbox having a removably attachable cover which optionally forms a roof. The cover has depressions which receive corresponding projections formed in the sand receptacle to lock the cover over the receptacle. The receptacle and cover resiliently deflect to enable engagement and disengagement. The receptacle has troughs molded therein for stowing a plurality of posts. The posts are erected to support the cover in a location spaced from and above the receptacle when it is desired that the cover serve as a roof for protecting children playing in the sandbox. The posts are received in sockets molded into the receptacle. The cover is preferably conical, opening downwardly, and has transparent windows formed therein. The receptacle has rounded edges for safety and hand grips for grasping and maneuvering.

10 Claims, 3 Drawing Sheets

SANDBOX WITH ATTACHABLE COVER

BACKGROUND OF THE INVENTION

1. Field of the Invention

The present invention relates to sandboxes, and more particularly to a sandbox having an attachable lid or cover. The novel sandbox is useful as a recreational device, plant growing receptacle, and in other applications wherein it is desired to have a removable cover which can be attached securely enough to resist dislodging by weather elements.

2. Description of the Prior Art

Sandboxes provide children with an opportunity to create imaginary roads, buildings, and the like on a small scale. They are usually sufficiently large and potentially messy to warrant being maintained outdoors. While this arrangement is satisfactory for homeowners and others who wish to exclude sand from inside homes and other buildings, it leads to problems with the sandbox itself. A sandbox is susceptible to rain, winds, airborne contaminants, and animals which might burrow or leave excretions in the absence of human or animal oversight.

A sandbox can be covered just as can any receptacle. However, due to its size, covers present problems of their own. For example, a cover can be readily dislodged and lose all effectiveness if no provision is made for securing it in place. U.S. Pat. No. 4,515,360, issued to James F. Mariol on May 7, 1985, describes a sandbox having a cover which slides laterally or horizontally into engagement with the sand receptacle. By contrast with the cover of Mariol, the cover of the present invention resiliently snap fits to its associated sandbox. Also, the sandbox has provision for storing and deploying posts for supporting the cover above the sand receptacle as a spaced apart roof.

U.S. Pat. No. 4,343,464, issued to Curtis R. Dose on Aug. 10, 1982, describes a playground assembly incorporating a sandbox which can be covered by rotating a hinged roof assembly into place over the sand receptacle. The roof assembly, which is convertible into a slide and a ladder when not covering the receptacle, is not detachable from the receptacle. By contrast, the cover of the present invention is detachable from the receptacle, and can be erected in a location establishing a roof located well above the sand receptacle.

Neither one of the above inventions and patents, taken either singly or in combination, is seen to describe the instant invention as claimed.

SUMMARY OF THE INVENTION

The present invention sets forth a sandbox which has a detachable cover which may be employed either to close the sand receptacle or alternatively as a roof sheltering the sand receptacle and its occupants from rain and sun. The cover resiliently snaps into engagement with the receptacle when it is desired to close the same. The receptacle is configured to house posts for supporting the cover above and spaced apart from the receptacle, when it is desired to afford access to children, while protecting the children from elements of the weather. The receptacle has sockets for receiving the posts and holding them in an upright position.

The receptacle has male projections located periodically about its outer periphery. The cover has corresponding recesses for receiving these projections. Both the receptacle and cover are fabricated from a slightly resilient material so that either or both can deflect to engage and release the projections. This arrangement allows ready installation and removal of the cover. No tools are necessary to erect and disassemble the sandbox as it is converted from the closed condition to the deployed condition. In the deployed condition, the cover, instead of becoming a useless article which merely gets in the way or must be disposed or stored away from the sandbox, serves as a roof. This is a desirable feature since children engrossed in play may be oblivious to hazards such as sunburn.

The sandbox also has handles for ready grasping and maneuvering when moving into a desired location, rounded edges for safety, and transparent windows formed in the cover to enable observation of the sandbox when the cover closes the receptacle. The various features of the novel sandbox are formed by molding the sandbox components from a suitable constituent material, such as synthetic resins. The sandbox thus can be fabricated economically while offering its various amenities.

Accordingly, it is a principal object of the invention to provide a sandbox having a readily removed attachable cover.

It is another object of the invention to provide a removable roof which shelters occupants of the sandbox.

It is a further object of the invention to enable ready stowage of the components of the sandbox.

Still another object of the invention is to provide handles for grasping the sandbox.

An additional object of the invention is to provide windows enabling observation of the receptacle when the cover is installed.

It is an object of the invention that the sandbox avoid sharp edges.

Yet another object of the invention is to enable ready conversion from the closed condition to the deployed condition wherein the cover serves as a roof.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
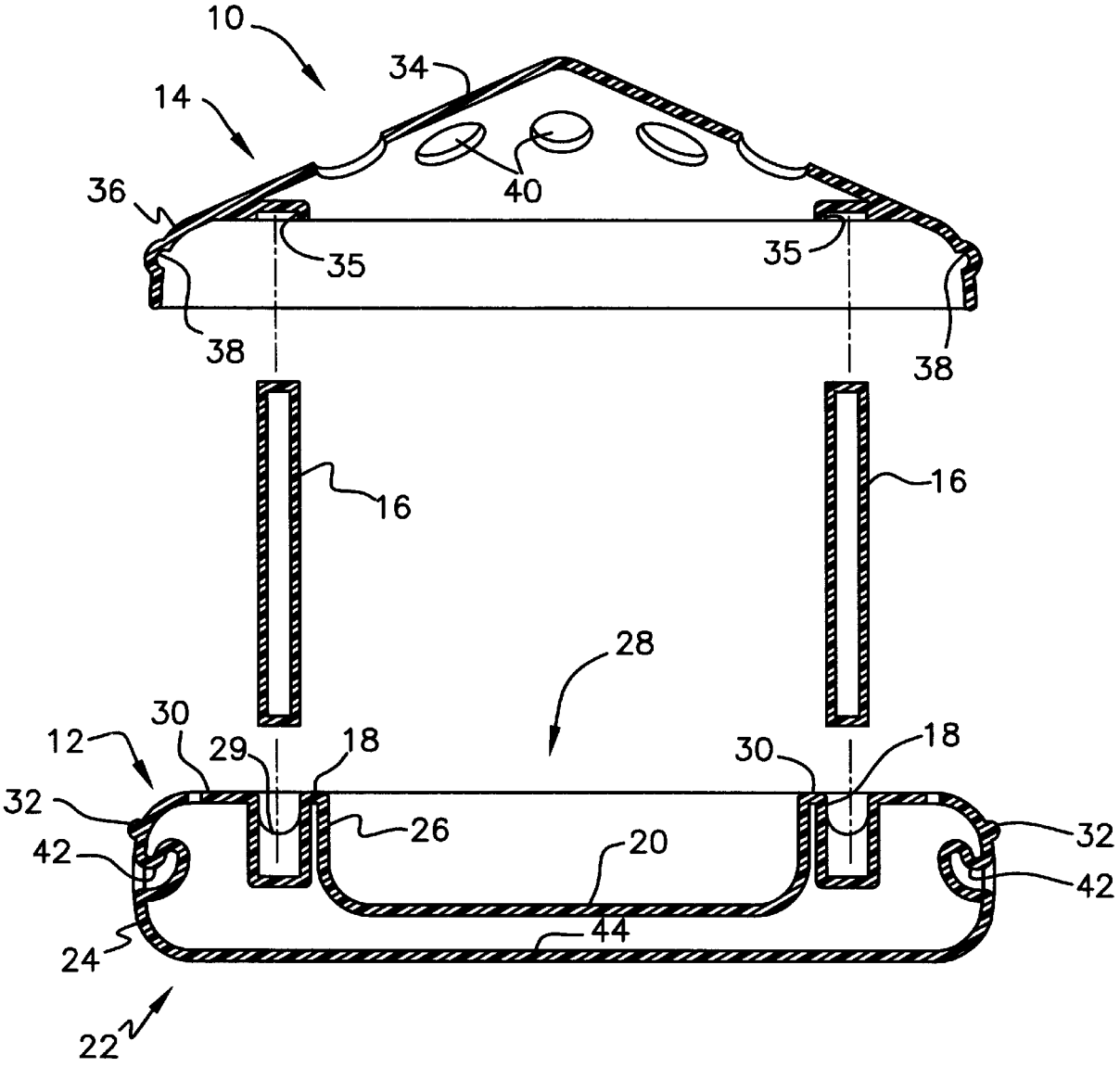
FIG. 1 is an exploded, cross sectional, side elevational view of the invention.
Figure 2:
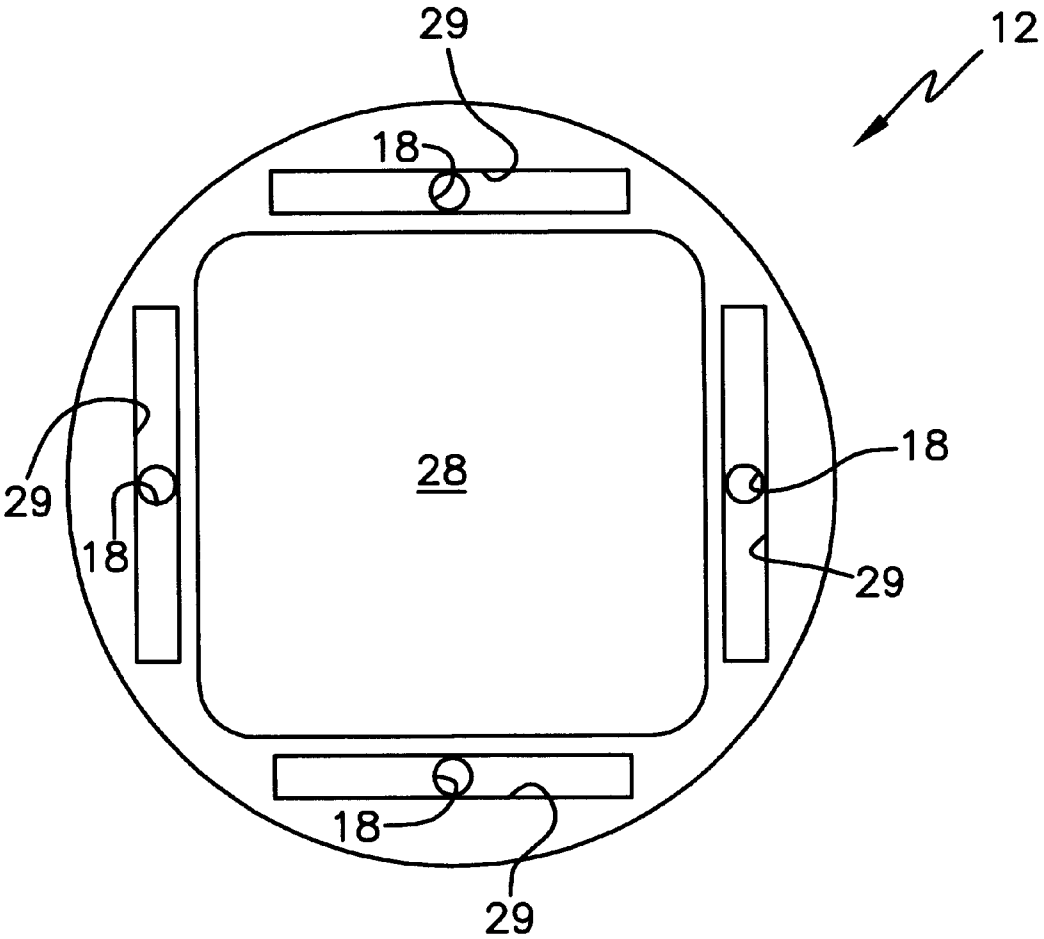
FIG. 2 is a top plan view of the lowermost component shown in FIG. 1.
Figure 3:
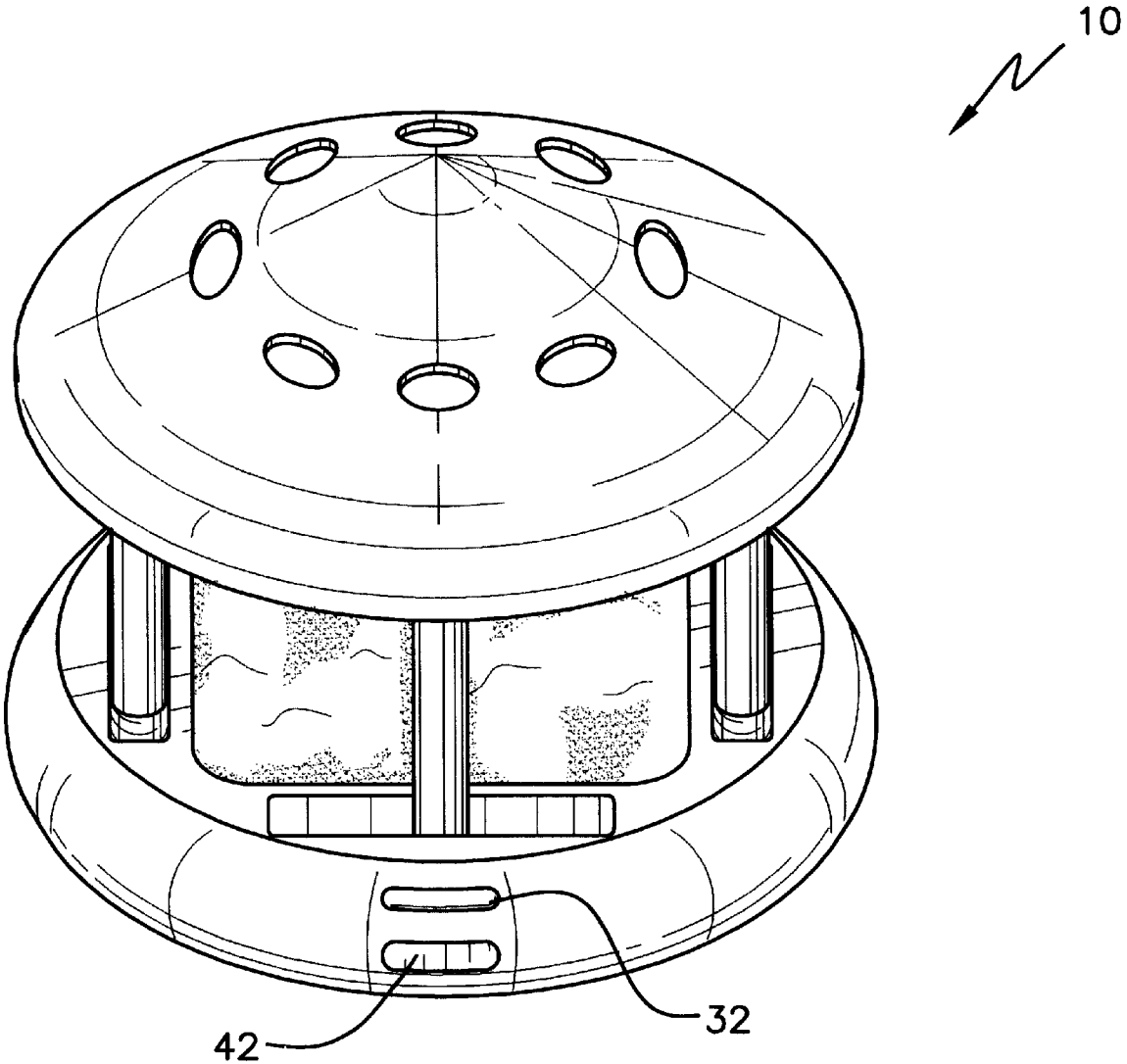
FIG. 3 is a perspective view of the invention.

Turning now to FIG. 1 of the drawings, separate components of sandbox 10 are seen to comprise an upwardly open vessel 12, a cover 14, and a plurality of posts 16. Cover 14 is removably detachable from vessel 12, and is optionally lowered into abutment and engagement with vessel 12, or alternatively may be supported above vessel 12 to form a roof. The latter condition is illustrated in FIG. 1, wherein posts 16 are inserted in sockets 18 formed in vessel 12. Each socket 18 is upwardly open, and is dimensioned and configured to receive one post 16 therein and to hold post 16 upright and erect.

Vessel 12 has a floor 20 and an upstanding peripheral wall 22 projecting from floor 20. Vessel 12 is preferably molded from a resilient synthetic resin such that no open seam exists between floor 20 and wall 22. In the preferred embodiment, wall 22 comprises an outer member 24 and an inner member 26. Although wall 22 could be solid, if fabricated from a closed cell expanded foam, for example, it is preferred that wall 22 be fabricated from a denser polymeric material, and include members 24, 26. Member 24 enables several features to be molded into wall 22, which features will be described hereinafter.

Floor 20 and wall 22 therefore collectively define an open receptacle 28 located within the bounds of wall 22 and above floor 20. Wall 22 has an upper surface 30 on which children may sit if not playing within receptacle 28. Troughs 29 are molded into wall 22, for receiving posts 16 for stowage when it is not desired to support cover 14 above receptacle 28. Troughs 29 are upwardly open, and are configured to enable posts 16 to lie horizontally when stowed. Each trough 29 is dimensioned and configured to receive one post 16 therein in loose cooperation therewith, so that posts 16 are readily removed. There is, of course, one trough 29 provided for each post 16.

A plurality of lateral projections 32 are formed in member 24 of wall 22 proximate upper surface 30. These projections 32 are located periodically about the periphery of vessel 12. Projections 32 cooperate in locking cover 14 to vessel 12.

Cover 14 comprises a panel 34 which is generally conical, and is dimensioned and configured to cover receptacle 28 when placed in a position overlying vessel 12. Cover 14 is downwardly open, when in the orientation depicted in FIG. 1. This characteristic enables rain and other contaminants to be readily shed to the ground rather than accumulate on cover 14. Cover 14 is dimensioned and configured to engage posts 16 when posts 16 are erect. Shallow sockets 35 are provided to establish adequate engagement such that cover 14 is supported on posts 16 and held above receptacle 28 a sufficient distance to clear children playing in receptacle 28.

Cover 14 includes a downwardly projecting peripheral wall 36 which interfits telescopingly with upstanding peripheral wall 22 of vessel 12. Cover 14 has a plurality of depressions 38 corresponding in locations, dimensions, and configuration to similar characteristics of lateral projections 32. When cover 14 is pressed into telescoping fit with vessel 12, walls 22 or 36 or both resiliently deflect to enable each projection 32 to be received in a corresponding one depression 38 such that cover 12 is thereby latched to vessel 12.

A plurality of transparent windows 40 are formed in cover 14, thereby enabling viewing of contents of receptacle 28 when cover 14 is in place covering receptacle 28.

Member 24 of wall 22 is formed to include hand grips 42. Hand grips 42 are configured so that the palms of a person's hand face upwardly when grasping vessel 12 by hand grips 42. Wall 22 is configured such that it exposes only rounded edges and features to the exterior, as seen at the lower right and left of FIG. 1. This characteristic reduces the likelihood of cutting children who might inadvertently contact sharp edges which might otherwise exist should wall 22 be terminated without rounding its features.

Dimensions of the preferred embodiment include an overall diameter of cover 14 of six feet, with the diameter of vessel 12 being roughly equivalent. Poles 16 are preferably four to five feet in length. The depth of receptacle 12, taken from floor 20 to the upper surface 30 of wall 22, is twelve inches. Floor 20 is preferably spaced some three inches above bottom panel 44 of vessel 12. Total height of cover 14 is twelve inches. The minimum diameter of receptacle 28 is at least three feet.

It is to be understood that the present invention is not limited to the embodiments described above, but encompasses any and all embodiments within the scope of the following claims.

We claim:

1. A sandbox having a removably attachable cover, comprising:

an upwardly open vessel having a floor and an upstanding peripheral wall projecting from said floor configured to define an open receptacle within said wall and above said floor, wherein said wall has an upper surface and a plurality of lateral projections proximate said upper surface and located about the periphery of said vessel; and a cover comprising a panel dimensioned and configured to cover said receptacle of said vessel when said cover overlies said vessel, and a downwardly projecting peripheral wall which interfits telescopingly with said upstanding peripheral wall of said vessel, wherein said cover has a plurality of depressions corresponding in locations, dimensions, and configuration to said lateral projections formed in said wall of said vessel such that said cover latches to said vessel when each said lateral projection is received in one said depression.

2. The sandbox according to claim 1, wherein said panel of said cover is conical and opens downwardly.

3. The sandbox according to claim 1, wherein said vessel and said cover are formed from a resilient material which resiliently deflects to selectively engage said lateral projections with said depressions and to release said lateral projections from said depressions.

4. The sandbox according to claim 1, further including a plurality of posts, and wherein said vessel has a plurality of upwardly open sockets formed therein, wherein each said socket is dimensioned and configured to receive one of said posts therein and to hold a said post erect when said post is inserted in a said socket, and wherein said cover is dimensioned and configured to engage said posts when said posts are erect such that said cover is supported on said posts and held above said receptacle of said vessel.

5. The sandbox according to claim 4, wherein said wall of said vessel has a plurality of upwardly open troughs formed therein, wherein each said trough is dimensioned and configured to receive one said post therein in loose cooperation therewith, there being one said trough for each said post.

6. The sandbox according to claim 1, wherein said receptacle has a minimum diameter of three feet.

7. The sandbox according to claim 1, wherein said panel of said cover has a plurality of transparent windows formed therein, thereby enabling viewing of contents of said receptacle when said cover is in place covering said receptacle.

8. The sandbox according to claim 1, wherein said upstanding peripheral wall of said vessel includes hand grips formed therein.

9. The sandbox according to claim 1, wherein said upstanding peripheral wall of said vessel exposes only rounded edges to the exterior.

10. A sandbox having a removably attachable cover, comprising:

an upwardly open vessel having a floor and an upstanding peripheral wall projecting from said floor configured to define an open receptacle within said wall and above said floor, wherein said wall has an upper surface, a plurality of lateral projections proximate said upper surface and located about the periphery of said vessel, hand grips formed in said wall, and exposes only rounded edges to the exterior;

a cover comprising a downwardly open, conical panel dimensioned and configured to cover said receptacle of said vessel when said cover overlies said vessel, and a downwardly projecting peripheral wall which interfits telescopingly with said upstanding peripheral wall of said vessel, wherein said cover has a plurality of depressions corresponding in locations, dimensions, and configuration to said lateral projections formed in said wall of said vessel such that said cover latches to said vessel when each said lateral projection is received in one said depression, and wherein said panel of said cover has a plurality of transparent windows formed therein, thereby enabling viewing of contents of said receptacle when said cover is in place covering said receptacle, wherein said vessel and said cover are formed from a resilient material which resiliently deflects to selectively engage said lateral projections with said depressions and to release said lateral projections from said depressions; and a plurality of posts, wherein said vessel has a plurality of upwardly open sockets formed therein, wherein each said socket is dimensioned and configured to receive one of said posts therein and to hold a said post erect when said post is inserted in a said socket, and wherein said cover is dimensioned and configured to engage said posts when said posts are erect such that said cover is supported on said posts and held above said receptacle of said vessel, and wherein said wall of said vessel has a plurality of upwardly open troughs formed therein, wherein each said trough is dimensioned and configured to receive one said post therein in loose cooperation therewith, there being one said trough for each said post.

* * * * *